United States Patent [19]

Ohnishi et al.

[11] 4,287,524

[45] Sep. 1, 1981

[54] ELECTROSTATIC RECORDING METHOD WITH DELAYED CONTROL VOLTAGE

[75] Inventors: Masaru Ohnishi; Kazuhiro Samejima, both of Amagasaki, Japan

[73] Assignee: Mitsubishi Denki Kabushiki Kaisha, Tokyo, Japan

[21] Appl. No.: 47,821

[22] Filed: Jun. 12, 1979

[30] Foreign Application Priority Data

Jul. 25, 1978 [JP] Japan ..... 53-91065

[51] Int. Cl.[3] ..... G03G 15/048

[52] U.S. Cl. ..... 346/154; 346/153

[58] Field of Search ..... 346/150, 153, 154

[56] References Cited

U.S. PATENT DOCUMENTS

| | | | |
|---|---|---|---|
| 3,528,073 | 9/1970 | Starr | 346/153 |
| 3,564,556 | 2/1971 | Tsukatani | 346/154 |
| 4,181,912 | 1/1980 | Satake | 346/154 |

FOREIGN PATENT DOCUMENTS

| | | | |
|---|---|---|---|
| 4413299 | 7/1965 | Japan | 346/154 |
| 46-21193 | 6/1971 | Japan . | |

*Primary Examiner*—John H. Wolff

*Attorney, Agent, or Firm*—Oblon, Fisher, Spivak, McClelland & Maier

[57] ABSTRACT

An electrostatic recording method using a single surface control electrostatic recording head where the control voltage pulse is delayed for a short time after the application of the recording voltage. The delay produces a potential difference large enough to prevent a decrease in the recording density due to fluctuation of temperature and humidity.

2 Claims, 8 Drawing Figures

ELECTROSTATIC RECORDING METHOD WITH DELAYED CONTROL VOLTAGE

BACKGROUND OF THE INVENTION

1. Field of the Invention

The present invention relates to an electrostatic recording system using one surface control electrostatic recording head. In particular, it relates to an electrostatic recording system in which a recording density is not reduced, even in a high temperature and high humidity atmosphere.

2. Description of The Prior Art

An electrostatic recording system using one surface control electrostatic recording head wherein control electrodes and many recording needle electrodes are located on the side of a dielectric layer of an electrostatic recording paper, has been widely used as a printer for a high speed facsimile or a computor because a set of a recording paper is simple, and high speed recording can be attained in comparison with a device using a two surface control electrostatic recording head, locating the electrodes separately on both surfaces of the electrostatic recording paper.

However, when the recording is performed by using a one surface control electrostatic recording head, the resistance of a conductive substrate of the electrostatic recording paper is reduced under the conditions of high temperature and high humidity, whereby the recording density is remarkably low and sometimes, the recording can not be performed at all.

The reduction of the recording density under the condition of high temperature and high humidity, can be reduced by slightly increasing the resistance of the conductive substrate. However, the resistance of the electric conductive substrate becomes too high under the conditions of low temperature and low humidity whereby the current for charging the dielectric layer of the electrostatic recording paper is too small to reduce the recording density, disadvantageously.

Thus, it is difficult to use only one electrostatic recording paper under wide ranges of the temperature and humidity. Accordingly two kinds of recording papers for low humidity or high humidity have been selected and used depending on the season.

The present invention is to overcome the disadvantages of the conventional recording system using a one surface control electrostatic recording head. In accordance with the present invention, normal recording can be performed without reducing the recording density under the conditions of high temperature and high humidity by using the recording papers designed for low humidity.

SUMMARY OF THE INVENTION

The present invention is to provide an electrostatic recording system wherein a one surface control electrostatic recording head comprises a row of many recording needle electrodes and control electrodes adjacent to the row of the electrodes; and a recording medium comprises a conductive substrate and a dielectric layer formed on one surface thereof; and the electrostatic recording head is brought into contact with the dielectric layer of the recording medium under pressure; a recording voltage is applied to the recording needle electrodes and a control voltage having smaller rise time constant than the recording voltage is applied to the control electrodes in the same period to form an electric charge image on the dielectric layer. The control voltage is applied after the potential of the recording needle electrodes has increased due to the application of the recording voltage.

DETAILED DESCRIPTION OF THE PREFERRED EMBODIMENTS

An analytical result of variation of potential of the conductive substrate paper below the control electrode to which the control voltage is applied, will be illustrated. The present invention has been attained from the analytical result.

Figure 1:
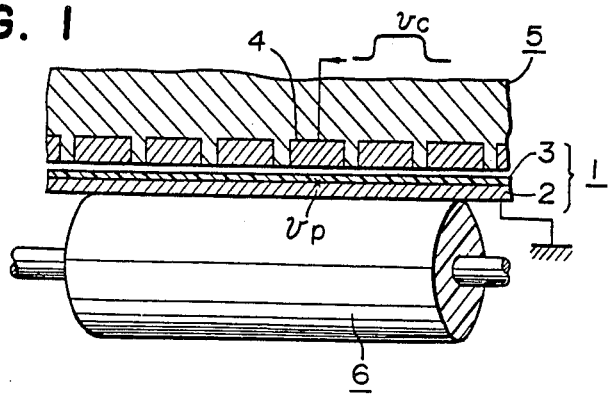
FIG. 1 is a partially enlarged sectional view of a part near the control electrodes in the recording by a one surface control electrostatic recording head.

FIG. 1 is a partially enlarged sectional view of a part near the control electrodes in a one surface control electrostatic recording head.

The reference numeral (1) designates an electrostatic recording paper comprising a conductive substrate paper (2) made by a conductive coating on both surfaces and a dielectric layer (3) on one surface. A one surface control electrostatic recording head (5) comprises control electrodes (4) and many recording needle electrodes (not shown). The reference numeral (6) designates a rubber roll for contacting the electrostatic recording paper (1) with the electrostatic recording head (5) under pressure.

In FIG. 1, when the control voltage $$v_c[v_c=V_c\{1-\exp(-t/\tau_c)\}]$$

increasing according to the time constant $\tau_c$ is applied to, the control electrode (4), the variation of the voltage $v_P$ of the conductive substrate paper (2) at the point having the symbol X in FIG. 1 is highly affected by the resistance of the conductive substrate paper (2).

Figure 2:
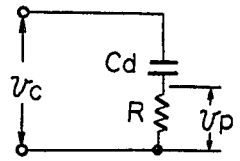
FIG. 2 is an approximate equivalent circuit thereof.

The approximate equivalent circuit of FIG. 2 is given. In FIG. 2, the reference Cd designates the capacitance between the control electrodes (4) and ground; R designates the resistance between ground and the control electrodes (4) of the conductive substrate paper (2). The value $v_P$ is given by the equation:

$$v_p = V_c \frac{CdR}{\tau c - CdR}(e^{-t/\tau c} - e^{-t/CdR}) \quad (1)$$

Figure 3:
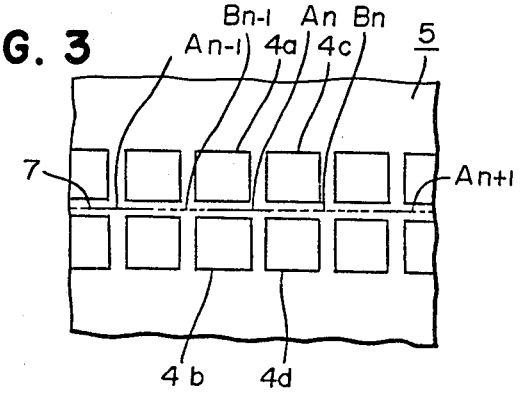
FIG. 3 is an enlarged view of a head surface of the one surface control electrostatic recording head.

FIG. 3 is a partially enlarged view of the one surface control electrostatic recording head (5) observed from the electrode surface side. In FIG. 3, $A_{n-1}$, $A_n$, $A_{n+1}$, $B_{n-1}$ and $B_n$ are respectively groups of the recording needle electrodes (7) divided into A and B groups for specific numbers (shown by the full line and the broken line). The control electrode is located so to face half of group A and half of group B of the recording needle electrodes.

The situation of applying the control voltage $v_c$ to the control electrodes (4*a*), (4*b*), (4*c*), (4*d*) for recording by the recording needle electrode $A_n$ group will be considered.

Figure 4:
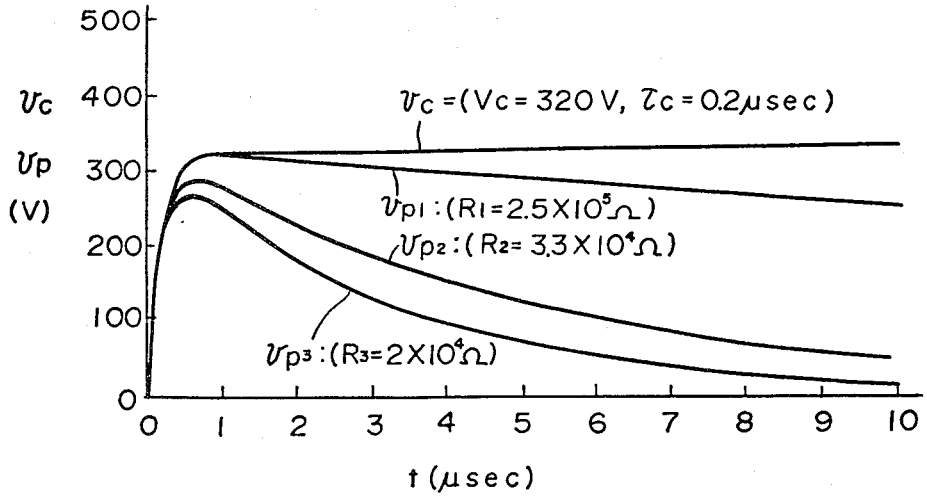
FIG. 4 is a characteristic diagram showing the time dependency of potential $v_p$ of a conductive substrate paper measured by the approximate equivalent circuit.

FIG. 4 is a characteristic diagram showing the variation of $v_P$ when the temperature and the humidity are varied for three levels using a standard electrostatic recording paper for low humidity.

In this example, the condition is as follows: $Cd=150_{PF}$; control voltage $V_c=320$ volt; $\tau_c=0.2$ μsec.; resistances from the grounded point to each of four control electrodes (4*a*)–(4*d*); $R_1=2.5\times10^5\Omega$, (20° C.; 50% RH); $R_2=3.3\times10^4\Omega$, (20° C.; 80% RH) and $R_3=2\times10^4\Omega$, (30° C.; 80% RH). These data are substituted in the equation (1) to calculate $v_P$. The results are shown as the characteristic curves $v_{P1}$, $v_{P2}$ and $v_{P3}$.

As it is understood from FIG. 4, in this method, the peak value $v_P$ is suddenly reduced depending on the reduction of the resistance R of the conductive substrate paper (2) caused by high temperature and high humidity.

Figure 5:
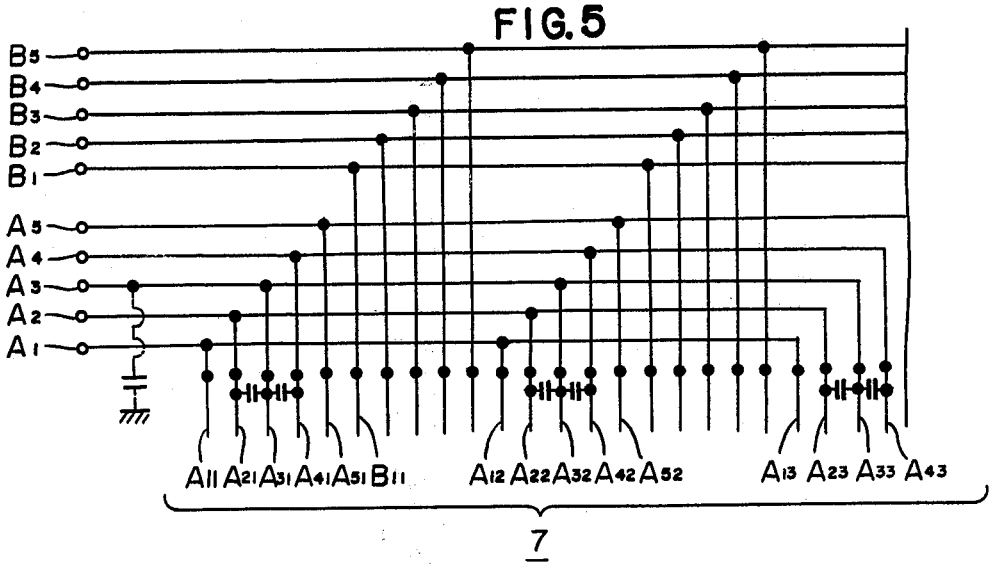
FIG. 5 is a diagram of groups of many needle electrodes.

FIG. 5 is a schematic view of many recording needle electrodes divided into two groups A and B and five recording needle electrodes (7) are given for each group as a simplified view. The $A_3$ group will be considered. The recording needle electrodes $A_{21}$, $A_{41}$ are located on both sides of the recording needle electrode $A_{31}$ each with a gap of 125 μm (in the case of 8 electrodes/mm) whereby a relatively large line capacity Cl is given.

The same fact is found for the recording needle electrodes $A_{32}$, $A_{35}$ in the $A_3$ group. Accordingly, the $A_3$ group of the recording needle electrodes has large line capacity n. Cl. The recording voltage $v_N$ applied to the recording needle electrodes in the $A_3$ group is induced to those of the $A_2$ group and the $A_4$ group whereby the recording is also performed by the recording needle electrodes in the $A_2$ group and the $A_4$ group.

When the recording voltage $v_N$ is applied to electrodes of the $A_2$ group and the $A_4$ group, the recording is also performed by those of the $A_3$ group. Such a crosstalk image deteriorates the quality of the recorded image.

Two typical methods of eliminating such crosstalk image by the line capacity Cl have been proposed.

The first method is to delay the time for applying the control voltage $v_c$ until after attenuating the crosstalk voltage caused by the recording voltage $v_N$ applied to the recording needle electrodes to the non-recording value as described in Japanese Patent Publication No. 21193/1971. This method is effective when the line capacity Cl is small and the attenuating time of the crosstalk voltage is short. However, in the case of electrostatic recording heads having many recording needle electrodes (7) and having high capacity such as several hundreds PF of the sum of the earth capacity $C_o$ in the groups and the line capacity n.Cl, such as the electrostatic recording heads used for the recent high speed facsimiles, it takes 10 μsec. or more for attenuating the crosstalk voltage to the non-recording value. Accordingly, this method can not be applied to a device for high speed recording such as recording 1 dot for shorter than 10 μsec.

Figure 6:
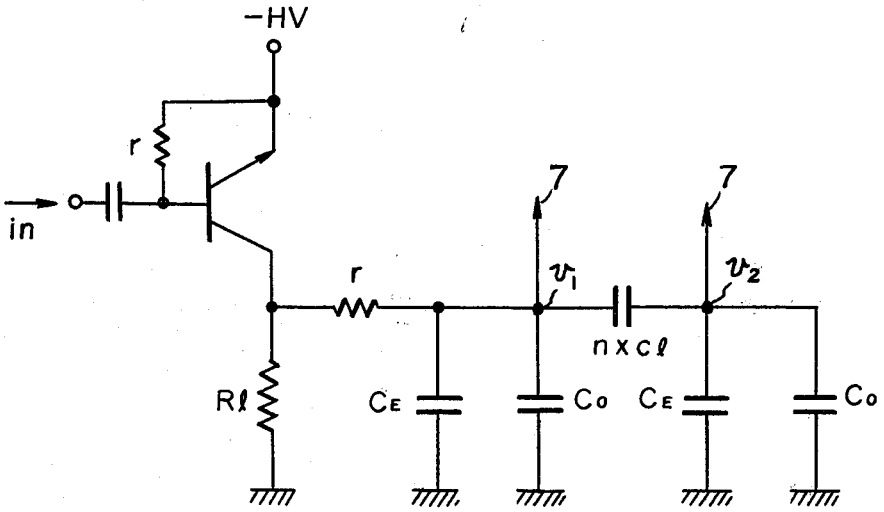
FIG. 6 is a circuit diagram of one embodiment of a recording needle driving circuit.

The second method is to connect a large capacitor $C_E$ to an output circuit for recording a voltage $v_N$ whereby a crosstalk voltage is reduced by dividing it into two capacities $C_E$ and n.Cl as in the recording needle electrode driving circuit of FIG. 6.

In FIG. 6, if $C_E$ equals zero $$v_2 = \frac{n \cdot Cl}{Co + n \cdot Cl} \cdot v_1,$$

but if $C_E$ is connected, $$v_2 = \frac{n \cdot Cl}{Co + C_E + n \cdot Cl} \cdot v_1.$$

Thus, the crosstalk voltage does not rise to the potential for the recording, whereby the crosstalk image is not formed even though the control voltage $v_c$ is applied to the control electrodes and the recording voltage $v_N$ is applied to the recording needle electrodes at the same time. However, the capacitor $C_E$ is large, whereby the time constant $\tau_N$ for rising the recording voltage $v_N$ is remarkably increased. In a practical device, the time constant may reach to 0.8 μsec.

Figure 7:
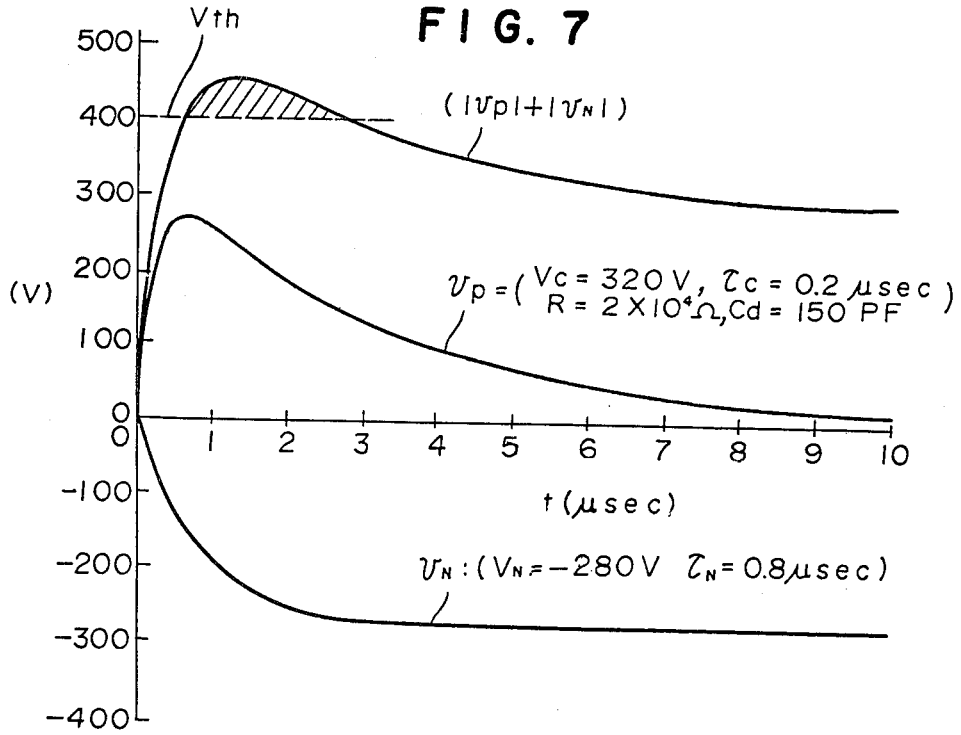
FIG. 7 is a characteristic diagram showing the relation of the potentials $v_p$, $v_N$ and $|v_P|+|v_N|$ of the conductive substrate paper, when the recording needle voltage $v_N$ and the control voltage $v_c$ are simultaneously applied as in the conventional system.

The recording on the electrostatic recording paper (1) is given by the potential difference $|v_c|+|v_N|$ between the control electrodes and the recording needle electrodes. As shown in FIG. 4, $v_c$ decreases faster than $v_N$ increases whereby a suitable potential difference required for the recording is not applied to cause the reduction of the recording density. FIG. 7 is the characteristic diagram for showing this condition wherein $v_P$ is the characteristic (corresponding to $v_{P3}$ in FIG. 4) in the following condition:

$V_c=320$ volt; $\tau_c=0.2$ μsec.; $R=2\times10^4\Omega$; amd $Cd=150$ PF and $v_N$ is the characteristic in the following condition; maximum $V_N=-280$ volt and $\tau_N=0.8$ μsec.; $|v_P|+|v_N|$ is the potential difference between the control electrodes and the recording needle electrodes and is larger than the recordable voltage Vth. In FIG. 7, the shading part is the region where recording occurs. When the area of the shading region is more than a constant value, a satisfactory recording density can be given.

As it is understood from FIG. 7, in the second method, by connecting a large capacitor $C_E$, the peak value of $v_P$ is suddenly reduced depending upon the reduction of the resistance R of the conductive substrate paper (2) caused by high temperature and high humidity. Accordingly, the reduction of the recording density could not be prevented.

The present invention is based on these findings of the analysis of the reason of the reduction of the recording density at high temperature and high humidity.

In the present method, the time for applying the control voltage $v_c$ is delayed from the time applying the recording voltage $v_N$ depending upon the condition (temperature and humidity) in the atmosphere (environment) whereby the time for providing $(|v_P|+|v_N|)>Vth$ is prolonged to prevent the reduction of the recording density.

Figure 8:
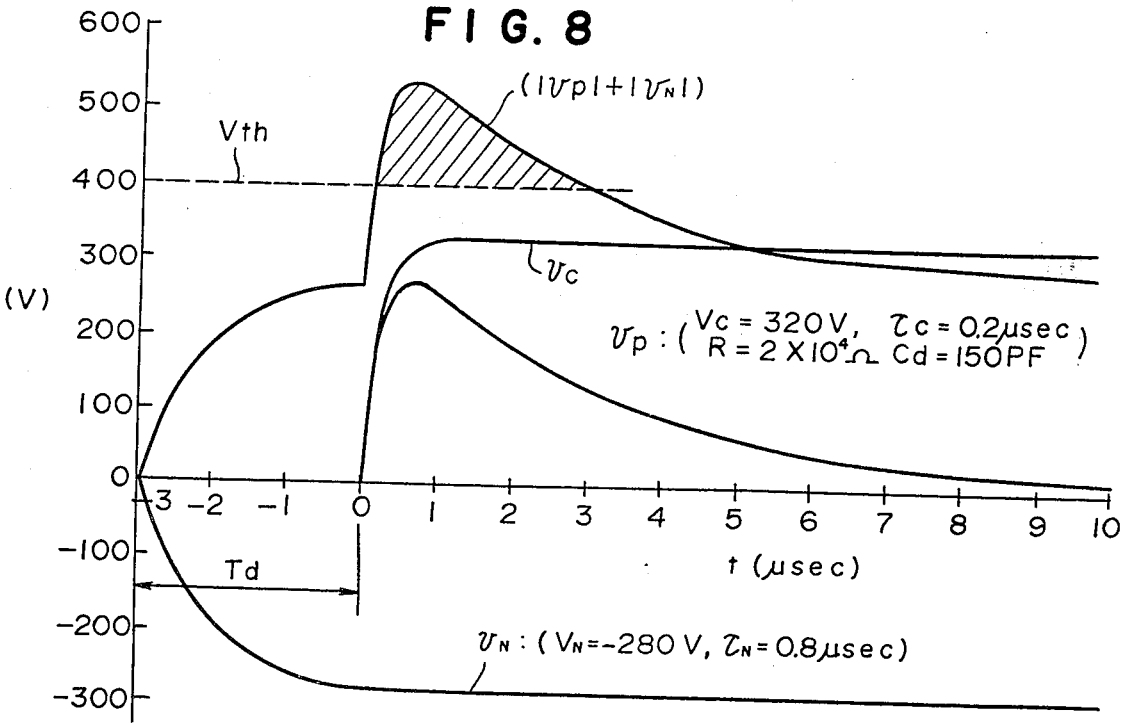
FIG. 8 is a characteristic diagram showing the relation of $v_N$, $v_c$, $v_P$ and $|v_P|+|v_N|$ given by the voltage driving system of the present invention.

FIG. 8 is the characteristic diagram for illustrating the recording method and the effect of the present invention and shows the relation of $v_c$, $v_P$, $v_N$ and $|v_P|+|v_N|$.

In the example, the recording voltage $v_N$ is applied at the time −3, to the recording needle electrodes. Then, the control voltage $v_c$ is applied at the time 0 for a delay of the period Td. At the time 0, the recording voltage $v_N$ is substantially saturated to be $v_N$. The peak value of $|v_P|+|v_N|$ during the time $v_P$ is applied in delayed form, is about 540 volt which is about 90 volt higher than that of FIG. 7 and the region where $|v_p|+|v_N|$ is greater than Vth is remarkably increased. Accordingly, even though the resistance of the insulating substrate paper is reduced, the recording density can be remarkably high.

It is preferable to set the period Td so that $v_c$ reaches about 90% of the maximum value $V_c$ when the value $v_N$ reaches 90% of the maximum value $V_N$ or later.

In said example, the condition of $\tau_c=0.2$ μsec. and $\tau_N=0.8$ μsec. is given. Thus, it is effective to be $\tau_c<\tau N$.

In said example, the relation of $|v_c|>|v_N|$ is given. Thus, it is also effective regardless the difference of $|v_c|$ and $|v_N|$. The polarity can be reversed to record it in positive. The recording medium is not always an electrostatic recording paper, but also includes various substrates recorded by a one surface control electrostatic recording head such as a conductive film having a dielectric layer on one surface thereof.

What is claimed is:

1. An electrostatic recording method for forming an electric charge image on a dielectric layer by (1) contacting a one surface control electrostatic recording head having rows of many recording needle electrodes and control electrodes adjacent to said recording needle electrodes, with the dielectric layer formed on a recording medium having a conductive substrate, and (2) applying a recording voltage to the recording needle electrodes and applying a control voltage having smaller rise time constant than the recording voltage to the control electrodes in the same period; the improvement wherein:

the control voltage is applied to the control electrodes at a time, $T_d$, later than the application of the recording voltage to the recording needle electrodes, $T_d$ being of a size so that the total voltage induced in the conductive substrate by the control voltage and the recording voltage has reached a potential equal to a large fraction of the maximum potential, and $T_d$ being significantly less than the time necessary for crosstalk voltage attenuation; whereby variations in environmental humidity and temperature do not effect recording density.

2. An electrostatic recording method using a one surface control electrostatic recording head according to claim 1 wherein the time for initiating the application of the recording voltage and the control voltage to reach the potential of the control electrodes to 90% of the maximum potential of the control electrode is set to the time when the potential of the recording needle electrodes reaches to 90% of the maximum potential or later.

* * * * *